US008764582B2

(12) United States Patent
Higuchi et al.

(10) Patent No.: US 8,764,582 B2
(45) **Date of Patent: *Jul. 1, 2014**

(54) MULTI-PIECE SOLID GOLF BALL

(75) Inventors: Hiroshi Higuchi, Chichibu (JP); Naoki Miyakoshi, Chichibu (JP); Akira Kimura, Chichibu (JP); Toru Ogawana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/652,529

(22) Filed: Jan. 12, 2007

(65) Prior Publication Data

US 2007/0111823 A1 May 17, 2007

Related U.S. Application Data

(63) Continuation of application No. 11/135,406, filed on May 24, 2005.

(51) Int. Cl.
*A63B 37/06* (2006.01)

(52) U.S. Cl.
USPC ..... 473/376

(58) Field of Classification Search
USPC ..... 473/376, 377, 373, 368, 374, 378
See application file for complete search history.

(56) References Cited

U.S. PATENT DOCUMENTS 4,919,434 A * 4/1990 Saito ..... 473/373
5,688,595 A 11/1997 Yamagishi et al.
5,772,531 A 6/1998 Ohsumi et al.
5,779,562 A 7/1998 Melvin et al.
5,816,937 A * 10/1998 Shimosaka et al. ..... 473/354
6,045,460 A 4/2000 Hayashi et al.
6,117,025 A * 9/2000 Sullivan ..... 473/373
6,117,026 A * 9/2000 Hayashi et al. ..... 473/374
6,123,630 A 9/2000 Hayashi et al.
6,213,895 B1 4/2001 Sullivan et al.
6,231,461 B1 5/2001 Moriyama et al.
6,248,027 B1 6/2001 Hayashi et al.
6,361,454 B1 3/2002 Yoshida et al.
6,406,383 B2 6/2002 Moriyama et al.
6,468,169 B1 10/2002 Hayashi et al.
6,561,928 B2 5/2003 Binette et al.
6,565,455 B2 * 5/2003 Hayashi et al. ..... 473/371

(Continued)

FOREIGN PATENT DOCUMENTS

JP 7-24085 A 1/1995
JP 8-336617 A 12/1996

(Continued)

*Primary Examiner* — Raeann Gorden
(74) *Attorney, Agent, or Firm* — Sughrue Mion, PLLC

(57) ABSTRACT

A multi-piece solid golf ball has a solid core, an envelope layer that encloses the solid core, an intermediate layer that encloses the envelope layer, and a cover that encloses the intermediate layer and has a plurality of dimples on a surface thereof. The diameter of the solid core, the center hardness, surface hardness and hardness difference between the center and surface of the solid core, the thickness and surface hardness of the envelope layer, and the thickness and surface hardness of the intermediate layer are each optimized within specific ranges. Moreover, the intermediate layer is formed so as to be harder than the envelope layer and the cover. In addition, the thickness and surface hardness of the cover, and the combined thickness of the envelope layer, intermediate layer and cover are each optimized within specific ranges.

13 Claims, 1 Drawing Sheet

(56) References Cited

U.S. PATENT DOCUMENTS

| | | | | |
|---|---|---|---|---|
| 6,585,608 | B2 | 7/2003 | Sullivan et al. | |
| 6,638,185 | B2 | 10/2003 | Kennedy et al. | |
| 6,685,579 | B2 | 2/2004 | Sullivan | |
| 6,702,694 | B1 | 3/2004 | Watanabe | |
| 6,705,956 | B1 | 3/2004 | Moriyama et al. | |
| 6,981,925 | B2 | 1/2006 | Shimizu et al. | |
| 7,121,960 | B2 | 10/2006 | Kasashima et al. | |
| 7,278,932 | B2 | 10/2007 | Kasashima et al. | |
| 2004/0033847 | A1 * | 2/2004 | Higuchi et al. | 473/371 |
| 2004/0038753 | A1 * | 2/2004 | Kato | 473/377 |
| 2004/0142770 | A1 | 7/2004 | Watanabe | |

FOREIGN PATENT DOCUMENTS

| | | | |
|---|---|---|---|
| JP | 9-248351 | A | 9/1997 |
| JP | 10-127818 | A | 5/1998 |
| JP | 10-127819 | A | 5/1998 |
| JP | 10-151226 | A | 6/1998 |
| JP | 10-295852 | A | 11/1998 |
| JP | 10-314342 | A | 12/1998 |
| JP | 10-328325 | A | 12/1998 |
| JP | 10-328326 | A | 12/1998 |
| JP | 10-328327 | A | 12/1998 |
| JP | 10-328328 | A | 12/1998 |
| JP | 11-4916 | A | 1/1999 |
| JP | 11-151321 | A | 6/1999 |
| JP | 2000-140160 | A | 5/2000 |
| JP | 2000-153007 | A | 6/2000 |
| JP | 2000-245873 | A | 9/2000 |
| JP | 2002-315848 | A | 10/2002 |
| JP | 2002-346000 | A | 12/2002 |
| JP | 2003-190330 | A | 7/2003 |
| JP | 2004-097802 | A | 4/2004 |
| JP | 2004-180822 | A | 7/2004 |
| JP | 2005-058320 | A | 3/2005 |

* cited by examiner

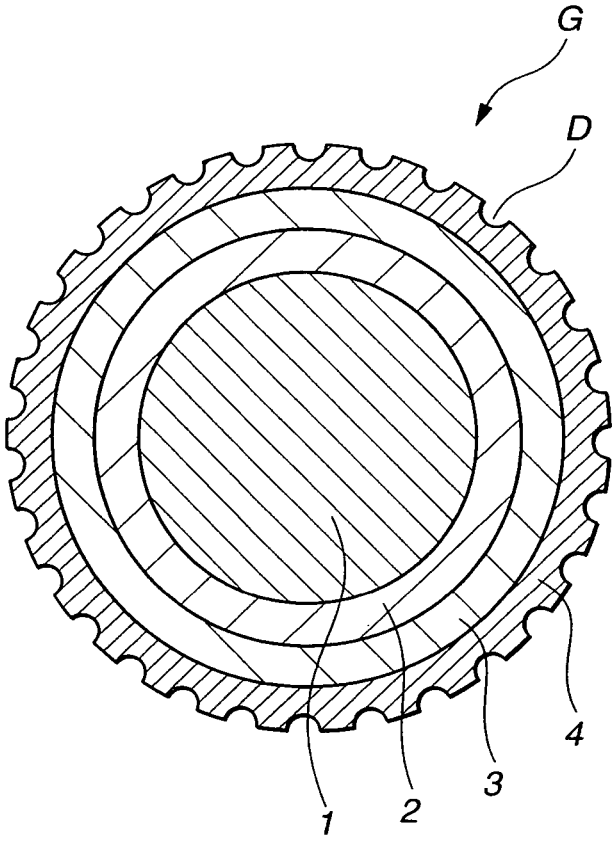
G
D
1
2
3
4

MULTI-PIECE SOLID GOLF BALL

This is a continuation of application Ser. No. 11/135,406 filed May 24, 2005. The entire disclosure of the prior application, application Ser. No. 11/135,406, is hereby incorporated by reference.

BACKGROUND OF THE INVENTION

The present invention relates to a multi-piece solid golf ball having a solid core, an envelope layer that encloses the core, and also an intermediate layer and a cover. More specifically, the invention relates to a multi-piece solid golf ball which has a high rebound on full shots with a driver, thereby increasing the distance traveled by the ball, and which also has a good performance on approach shots and a good feel upon impact.

A variety of golf balls having multilayer constructions that include a core and a cover as constituent elements have hitherto been disclosed for the purpose of increasing the distance traveled by the ball. Many of these golf balls have a solid core of one or two layers made of a rubber composition and a cover of one or more layers which is made of a thermoplastic resin and encloses the solid core. These golf balls are described in the following U.S. patent specifications and Japanese Kokai publications.

JP-A 7-24085
JP-A 10-127819
JP-A 10-151226
JP-A 11-4916
JP-A 2002-315848
JP-A 2003-190330
U.S. Pat. No. 5,779,562
(corresponding Japanese application: JP-A 10-314342)
U.S. Pat. No. 6,213,895
U.S. Pat. No. 6,585,608
U.S. Pat. No. 6,638,185
U.S. Pat. No. 6,561,928
U.S. Pat. No. 5,688,595
(corresponding Japanese application: JP-A 8-336617)
U.S. Pat. No. 5,816,937
(corresponding Japanese application: JP-A 9-248351)
U.S. Pat. No. 5,772,531
(corresponding Japanese application: JP-A 10-127818)
U.S. Pat. No. 6,231,461
(corresponding Japanese application: JP-A 10-295852)
U.S. Pat. No. 6,123,630
(corresponding Japanese application: JP-A 10-328325)
U.S. Pat. No. 6,468,169
(corresponding Japanese application: JP-A 10-328326)
U.S. Pat. No. 6,045,460)
(corresponding Japanese application: JP-A 10-328327)
U.S. Pat. No. 6,248,027
(corresponding Japanese application: JP-A 10-328328)
U.S. Pat. No. 6,117,026
(corresponding Japanese application: JP-A 11-151321)
U.S. Pat. No. 6,361,454
(corresponding Japanese application: JP-A 2000-140160)
U.S. Pat. No. 6,406,383
(corresponding Japanese application: JP-A 2000-153007)
U.S. Pat. No. 6,705,956
(corresponding Japanese application: JP-A 2000-245873)

To increase the distance traveled, which is the principal aim in a golf ball, it is necessary to increase the rebound of the ball. In order to obtain the rebound desired for this purpose, trial-and-error research is being carried out in which the hardnesses and thicknesses of the individual layers making up a golf ball are suitably adjusted and determinations are made of the degree of kinetic energy and the rebound performance that can be ultimately achieved from the impact energy generated when the ball is hit. Moreover, it is desired that golf balls not only have a good distance but also provide a good performance on approach shots (controllability on approach shots) and a good feel on impact; the pursuit of increased distance by itself often compromises the feel and controllability of the ball. In the foregoing prior-art multi-piece solid golf balls, there remains room for improvement in the distance, in addition to which the performance of the ball on approach shots and the feel on impact leave much to be desired. A need thus exists for golf balls having a better overall performance.

In light of the above circumstances, the object of the present invention is to provide a multi-piece solid golf ball which imparts a large rebound on full shots taken with a driver and thus increases the distance traveled by the ball, and which also has a good performance on approach shots and a good feel on impact.

SUMMARY OF THE INVENTION

We have conducted extensive investigations to achieve the above object. As a result, we have found that, in multilayer golf balls which have a solid core, an envelope layer that encloses the solid core, an intermediate layer that encloses the envelope layer, and a cover that encloses the intermediate layer and has a plurality of dimples on a surface thereof, by optimizing within specific ranges the diameter of the solid core, the center hardness, surface hardness and hardness difference between the center and surface of the solid core, the thickness of the envelope layer and the hardness of the envelope layer material, and the thickness of the intermediate layer and the hardness of the intermediate layer material, by forming the intermediate layer so as to be harder than the envelope layer and the cover, and by optimizing within specific ranges the thickness and of the cover, the hardness of the cover material and the combined thickness of the envelope layer, intermediate layer and cover, the distance traveled by the ball on full shots with a driver increases and a feel that leaves a good impression on the player can be obtained. Moreover, the ball has an appropriate spin performance on approach shots and a good controllability.

Accordingly, the invention provides the following multi-piece solid golf balls.

(1) A multi-piece solid golf ball comprising a solid core, an envelope layer that encloses the solid core, an intermediate layer that encloses the envelope layer, and a cover that encloses the intermediate layer and has a plurality of dimples on a surface thereof, wherein the solid core has a diameter of 34.0 to 41.0 mm, a center hardness expressed as the Shore D hardness of 15 to 45, a surface hardness expressed as the Shore D hardness of 40 to 63, and a hardness difference between the center and surface, expressed in Shore D hardness units, of 10 to 40; the envelope layer has a thickness of 0.2 to 1.2 mm and the material of which it is made has a Shore D hardness of 45 to 65; the intermediate layer has a thickness of 0.5 to 1.5 mm, the material of which it is made has a Shore D hardness of 55 to 75, and the intermediate layer is formed so as to be harder than the envelope layer and the cover; the cover has a thickness of 0.6 to 1.5 mm and the material of which it is made has a Shore D hardness of 30 to 60; and the combined thickness of the envelope layer, intermediate layer and cover is from 1.5 to 3.5 mm.

(2) The multi-piece solid golf ball of (1) above, wherein the solid core is composed primarily of a polybutadiene which has a cis-1,4 bond content of at least 60 wt % and is synthesized using a rare-earth catalyst.

(3) The multi-piece solid golf ball of (1) above, wherein the envelope layer and intermediate layer are made primarily of a thermoplastic resin selected from among ionomer resins, polyester elastomers, polyamide elastomers, polyurethanes, and mixtures thereof.

(4) The multi-piece solid golf ball of (1) above, wherein the cover is made primarily of a thermoplastic or thermoset polyurethane.

(5) The multi-piece solid golf ball of (1) above wherein, of the envelope layer, intermediate layer and cover, the intermediate layer is formed to the largest thickness.

(6) The multi-piece solid golf ball of (1) above, wherein the cover material and the intermediate layer material have a Shore D hardness difference therebetween of 2 to 30.

(7) The multi-piece solid golf ball of (1) above, wherein the material of which the intermediate layer is made includes trimethylolpropane or Polytail or the intermediate layer has been treated at the surface thereof with a primer.

(8) The multi-piece solid golf ball of (1) above, wherein the number of dimples is from 250 to 420 and the dimples overall have an average depth of 0.125 to 0.150 mm, an average diameter of 3.7 to 5.0 mm and are composed of a combination of four or more dimple types.

BRIEF DESCRIPTION OF THE DIAGRAM

FIG. 1 is a schematic cross-sectional view of a multi-piece solid golf ball (four-layer construction) according to the invention.

DETAILED DESCRIPTION OF THE INVENTION

The invention is described more fully below. The multi-piece solid golf ball of the invention, as shown in FIG. 1, is a multi-layer golf ball G having four or more layers, including a solid core 1, an envelope layer 2 that encloses the solid core, an intermediate layer 3 that encloses the envelope layer, and a cover layer 4 that encloses the intermediate layer. The cover layer 4 has a plurality of dimples D formed on the surface thereof. The solid core 1 or intermediate layer 3 is not limited to a single layer, and may be formed of a plurality of two or more layers.

The solid core can be formed using a rubber composition containing (I) a base rubber, (II) a co-crosslinking agent, (III) an organic peroxide, (IV) an inorganic filler, and (V) an organosulfur compound.

The base rubber (I) of this rubber composition, while not subject to any particular limitation, is typically a general-purpose synthetic rubber used in core formulations, and preferably one in which polybutadiene serves as the primary component. "Primary component" here signifies that the polybutadiene accounts for a proportion of the base rubber that is at least 50 wt %, preferably at least 70 wt %, and most preferably 100 wt %.

The polybutadiene has a cis-1,4 bond content of at least 60%, preferably at least 80%, more preferably at least 90%, and most preferably at least 95%, and has a 1,2-vinyl bond content of not more than 2%, preferably not more than 1.7%, and more preferably not more than 1.5%. Outside of this range, the rebound decreases.

It is recommended that the polybutadiene have a Mooney viscosity ($ML_{1+4}$ (100° C.)) of at least 30, preferably at least 35, more preferably at least 40, and most preferably at least 50, preferably at least 52, and that the upper limit be preferably not more than 100, more preferably not more than 80, even more preferably not more than 70, and most preferably not more than 60.

The term "Mooney viscosity" used herein refers in each instance to an industrial indicator of viscosity (JIS K6300) as measured with a Mooney viscometer, which is a type of rotary plastometer. This value is represented by the symbol $ML_{1+4}$ (100° C.), wherein "M" stands for Mooney viscosity, "L" stands for large rotor (L-type), and "1+4" stands for a preheating time of 1 minute and a rotor rotation time of 4 minutes. The "100° C." indicates that measurement was carried out at a temperature of 100° C.

The polybutadiene has a polydispersity index Mw/Mn (where Mw is the weight-average molecular weight, and Mn is the number-average molecular weight) of generally at least 2.0, preferably at least 2.2, more preferably at least 2.4, and even more preferably at least 2.6, but generally not more than 6.0, preferably not more than 5.0, more preferably not more than 4.0, and even more preferably not more than 3.4. A polydispersity Mw/Mn which is too small may lower the workability, whereas one that is too large may lower the rebound.

The polybutadiene is one that is synthesized using a rare-earth catalyst or a group VIII catalyst. The catalyst used for synthesis is preferably a rare-earth catalyst. Examples of rare-earth catalysts that may be used for this purpose include known rare-earth catalysts made up of a combination of a lanthanide series rare-earth compound, an organoaluminum compound, an alumoxane, a halogen-bearing compound and an optional Lewis base; and catalysts composed of a metallocene complex.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in Fine Chemical 23, No. 9, 5 (1994), J. Am. Chem. Soc. 115, 4971 (1993), and J. Am. Chem. Soc. 117, 6465 (1995) are also acceptable.

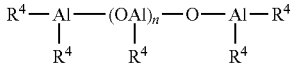

(I)

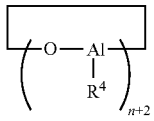

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 content and a low 1,2-vinyl content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30 to +150° C., and preferably 10 to 100° C.

The polybutadiene may be a modified polybutadiene obtained by polymerization using the above-described rare-earth catalyst, followed by the reaction of a terminal modifier with active end groups on the polymer.

A known terminal modifier may be used for this purpose. Illustrative examples include compounds of types (a) to (g) below.

(a) The modified polybutadiene can be obtained by reacting an alkoxysilyl group-bearing compound with active end groups on the polymer. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyl triethoxysilane, (3-glycidyloxy propyl)methyl dimethoxysilane, (3-glycidyloxypropyl) methyldiethoxysilane, β-(3,4- epoxycyclohexyl)tri methoxysilane, β-(3,4- epoxy cyclohexyl)triethoxysilane, β-(3,4- epoxycyclohexyl)methyldimethoxysilane, β-(3,4-epoxycyclohexyl)ethyldi methoxysilane, condensation products of 3-glycidyloxypropyltrimethoxysilane, and condensation products of (3-glycidyloxypropyl)methyldimethoxysilane; and isocyanate group-bearing alkoxysilane compounds such as 3-isocyanatopropyltrimethoxysilane, 3-isocyanatopropyl triethoxysilane, (3-isocyanatopropyl) methyldimethoxysilane, (3-isocyanatopropyl) methyldiethoxysilane, condensation products of 3-isocyanatopropyltrimethoxysilane and condensation products of (3-isocyanatopropyl)methyl dimethoxysilane.

A Lewis acid can be added to accelerate the reaction when the above alkoxysilyl group-bearing compound is reacted with active end groups. The Lewis acid acts as a catalyst to promote the coupling reaction, thus improving cold flow by the modified polymer and providing a better shelf stability. Examples of suitable Lewis acids include dialkyltin dialkyl malates, dialkyltin dicarboxylates and aluminum trialkoxides.

Other types of terminal modifiers that may be used include:

(b) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(c) heterocumulene compounds having on the molecule a Y═C═Z linkage (wherein Y is a carbon, oxygen, nitrogen or sulfur atom; and Z is an oxygen, nitrogen or sulfur atom);

(d) three-membered heterocyclic compounds containing on the molecule the following bonds

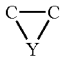

(wherein Y is an oxygen, nitrogen or sulfur atom);

(e) halogenated isocyano compounds;

(f) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

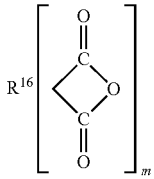

(wherein $R^8$ to $R^{16}$ are each independently a hydrocarbon group of 1 to 50 carbons, X is a halogen atom, and m is an integer from 1 to 5); and (g) carboxylic acid metal salts of the formula $R^{17}_lM''(OCOR^{18})_{4-l}$, $R^{19}_lM''(OCO—R^{20}—COOR^{21})_{4-l}$ or

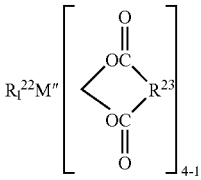

(wherein $R^{17}$ to $R^{23}$ are each independently a hydrocarbon group of 1 to 20 carbons, M" is a tin, silicon or germanium atom, and the letter l is an integer from 0 to 3).

Specific examples of the above terminal modifiers (a) to (g) and methods for their reaction are described in, for example, JP-A 11-35633 and JP-A 7-268132.

Sulfur can be added to the polybutadiene so as to increase the hardness distribution of the core. This sulfur may be in the form of a powder, such as the dispersible sulfur produced by Tsurumi Chemical Industry Co., Ltd. under the trade name "Sulfur Z."

The amount of sulfur included per 100 parts by weight of the polybutadiene is generally at least 0.01 part by weight, preferably at least 0.02 part by weight, and more preferably at least 0.05 part by weight. The upper limit is generally not more than 0.5 part by weight, preferably not more than 0.3 part by weight, even more preferably not more than 0.2 part by weight, and most preferably not more than 0.1 part by weight. If too little sulfur is included, it may not be possible to make the hardness distribution within the solid core at least a certain minimum size, as a result of which the rebound resilience may decrease, shortening the distance traveled by the ball. On the other hand, too much sulfur may give rise to undesirable effects, such as explosion of the rubber composition during molding under applied heat.

The co-crosslinking agent (II) may be an unsaturated carboxylic acid and/or a metal salt thereof.

Here, specific examples of unsaturated carboxylic acids include acrylic acid, methacrylic acid, maleic acid and fumaric acid. Acrylic acid and methacrylic acid are especially preferred.

A zinc or magnesium salt of an unsaturated fatty acid, such as zinc methacrylate or zinc acrylate, may be included as the metal salt of such an unsaturated carboxylic acid. The use of zinc acrylate is especially preferred.

The unsaturated carboxylic acid and/or metal salt thereof is included in an amount, per 100 parts by weight of the base rubber, of generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much may make the core too hard, giving the ball an unpleasant feel on impact, whereas too little may lower the rebound of the ball.

The organic peroxide (III) may be a commercially available product, illustrative examples of which include Percumil D (produced by NOF Corporation), Perhexa 3M (NOF Corporation), Perhexa C-40, Perhexa HC and Perhexa TMH (all produced by NOF Corporation), and Luperco 231XL (Atochem Co.). The use of Perhexa C-40, which is 1,1-bis (tert-butylperoxy)cyclohexane, is especially preferred. If necessary, two or more different organic peroxides may be mixed and used together.

The amount of organic peroxide included per 100 parts by weight of the base rubber is generally at least 0.1 part by weight, preferably at least 0.2 part by weight, more preferably at least 0.3 part by weight, and most preferably at least 0.4 part by weight, but generally not more than 3.0 parts by weight, preferably not more than 2.0 parts by weight, more preferably not more than 1.0 part by weight, even more preferably not more than 0.8 part by weight, and most preferably not more than 0.6 part by weight. Too much or too little organic peroxide may make it impossible to achieve a good hardness distribution, thus compromising the feel, durability and rebound of the ball.

In addition, an antioxidant may be included if necessary. For example, a commercial antioxidant such as Nocrac NS-6, Nocrac NS-30 (both available from Ouchi Shinko Chemical Industry Co., Ltd.), or Yoshinox 425 (available from Yoshitomi Pharmaceutical Industries, Ltd.) may be used for this purpose. To improve rebound and durability, it is recommended that the amount of antioxidant included per 100 parts by weight of the base rubber be 0 or more part by weight, preferably at least 0.05 part by weight, more preferably at least 0.1 part by weight, and most preferably at least 0.2 part by weight, but generally not more than 3 parts by weight, preferably not more than 2 parts by weight, more preferably not more than 1 part by weight, and most preferably not more than 0.5 part by weight.

Illustrative examples of the inert filler (IV) include zinc oxide, barium sulfate and calcium carbonate. The amount of inert filler included per 100 parts by weight of the base rubber is generally at least 5 parts by weight, preferably at least 7 parts by weight, more preferably at least 10 parts by weight, and most preferably at least 13 parts by weight, but generally not more than 80 parts by weight, preferably not more than 50 parts by weight, more preferably not more than 45 parts by weight, and most preferably not more than 40 parts by weight. Too much or too little inert filler may make it impossible to achieve a proper weight and a suitable rebound.

The organosulfur compound (V) is used to impart an excellent rebound. No particular limitation is imposed on the organosulfur compound, provided it improves the rebound of the golf ball. Exemplary organosulfur compounds include thiophenols, thionaphthols, halogenated thiophenols, and metal salts thereof, as well as polysulfides having 2 to 4 sulfurs. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is generally at least 0.1 part by weight, preferably at least 0.2 part by weight, more preferably at least 0.4 part by weight, and most preferably at least 0.7 part by weight. The upper limit is generally not more than 5 parts by weight, preferably not more than 4 parts by weight, more preferably not more than 3 parts by weight, even more preferably not more than 2 parts by weight, and most preferably not more than 1.5 parts by weight. Too much organosulfur compound may make the core too soft, whereas too little organosulfur compound makes any improvement in rebound unlikely.

In the practice of the invention, the method of forming the solid core may involve vulcanizing and curing the rubber composition composed primarily of the above-described base rubber by a known process to give a spherical molded and vulcanized body. Vulcanization can generally be carried out at a temperature of 100 to 200° C. for a period of 10 to 40 minutes.

Next, the physical properties of the solid core in the invention are described.

The solid core has a diameter of at least 34.0 mm, preferably at least 35.0 mm, more preferably at least 35.5 mm, and most preferably at least 36.3 mm, but not more than 41.0 mm, preferably not more than 39.0 mm, more preferably not more than 38.5 mm, and most preferably not more than 38.2 mm.

The solid core has a center hardness, expressed as the Shore D hardness, of at least 15, preferably at least 20, more preferably at least 25, and most preferably at least 30, but not more than 45, preferably not more than 43, more preferably not more than 41, and most preferably not more than 38. If the solid core has a center hardness that is higher than this range and thus excessive, the feel of the ball on impact will worsen. On the other hand, if the center hardness is too soft, the durability of the ball will be compromised.

The solid core has a surface hardness, expressed as the Shore D hardness, of at least 40, preferably at least 42, more preferably at least 43, and most preferably at least 44, but not more than 63, preferably not more than 62, more preferably not more than 61, and most preferably not more than 60. At a surface hardness higher than this range, the feel of the ball worsens. On the other hand, at a surface hardness that is too soft, the spin increases, shortening the carry of the ball.

The hardness difference obtained by subtracting the Shore D hardness at the center of the solid core from the Shore D hardness at the surface of the solid core is at least 10, preferably at least 12, more preferably at least 13, and most preferably at least 14, but not more than 40, preferably not more than 36, more preferably not more than 31, and most preferably not more than 25. A suitable hardness difference within this range reduces the spin rate on full shots with a driver, enabling the ball to travel a longer distance.

The above hardnesses were measured as follows. Specifically, the value obtained by measuring the core surface directly with a Shore D durometer was used as the surface hardness of the core. In addition, the core was cut into two and the value measured at the center of the cut face with a Shore D durometer was used as the center hardness of the core. Each hardness value is the average of two measurements taken on ten sample cores (the same applies below).

Next, the envelope layer which encloses the solid core is described. The envelope layer material is not subject to any particular limitation, although it is preferable to form the envelope layer primarily of a thermoplastic resin. Exemplary thermoplastic resins include ionomer resins, polyester elastomers, polyamide elastomers, urethane resins, and mixtures thereof. Illustrative examples of such resins that may be used include polyester thermoplastic elastomers of the Hytrel series (produced by DuPont-Toray Co., Ltd.), ionomer resins of the Himilan series (DuPont-Mitsui Polychemicals Co., Ltd.) and Surlyn series (E.I. du Pont de Nemours & Co.), and polyurethane thermoplastic elastomers of the Pandex series that are prepared with an aliphatic or aromatic diisocyanate (DIC Bayer Polymer, Ltd.). Any one or mixtures of two or more of these may be used. The above thermoplastic resin may have additives compounded therewith, including an inorganic filler such as zinc oxide or barium sulfate as a weight modifier, and titanium dioxide as a colorant.

Various thermoplastic elastomers and other polymers may be blended as optional ingredients together with the thermoplastic resin of which the envelope layer is primarily composed. Specific examples of such polymers that may be compounded include polyamide elastomers, styrene-based block elastomers, hydrogenated polybutadiene and ethylene-vinyl acetate (EVA) copolymers.

The envelope layer has a thickness of at least 0.2 mm, preferably at least 0.4 mm, more preferably at least 0.5 mm, and most preferably at least 0.6 mm, but not more than about 1.2 mm, preferably not more than 1.1 mm, more preferably not more than 1.0 mm, and most preferably not more than 0.9 mm. If the envelope layer has a thickness greater than the above range, the ball will have increased spin when hit with a driver and a smaller rebound, compromising the flight performance.

Although no particular limitation is imposed on the method of enclosing the solid core within the envelope layer, for an envelope layer made of a thermoplastic resin, a known method such as one that involves injection molding the envelope layer-forming composition about the periphery of the solid core may be employed.

If the envelope layer is to be thinly formed as described above, to avoid the risk of defective molding, the envelope layer-forming composition may first be molded to a thickness of 1.0 mm or more with an injection molding machine, and areas of excess thickness subsequently ground down to give an envelope layer of the desired thickness. Such a grinding method can be carried out with a known grinder. It is especially preferable to use a grinder equipped with a cylindrical grinding tool in which a plurality of grooves corresponding in shape to the curved surfaces of the spherical workpieces to be ground are formed on the periphery thereof along the axis of rotation, and with a cylindrical restraining tool disposed parallel to the grinding tool. In such a grinder, the spherical workpieces are placed between the grinding tool and the restraining tool, and the two tools are rotated in the same direction at a given peripheral speed ratio therebetween while the restraining tool is made to reciprocate at the same time along its axis of rotation, thereby grinding the surface of the spherical workpieces. By using this grinder, the spherical workpieces can be evenly and uniformly ground, enabling the formation of a thin, high-quality envelope layer.

The material of which the envelope layer is made has a Shore D hardness of at least 45, preferably at least 47, more preferably at least 50, and most preferably at least 52, but not more than 65, preferably not more than 63, even more preferably not more than 60, and most preferably not more than 58. If the envelope layer material is too soft, the spin rate will increase, lowering the flight performance. On the other hand, if the material is too hard, the feel on impact worsens.

Next, the intermediate layer is described. The intermediate layer material is preferably a thermoplastic resin, specific examples of which include ionomer resins, polyester elastomers, polyamide elastomers, urethane resins, and mixtures thereof. If necessary, dispersion aids and various additives such as UV absorbers, antioxidants and metallic soaps can also be included in the intermediate layer.

The intermediate layer has a thickness of at least 0.5 mm, preferably at least 0.7 mm, more preferably at least 0.8, and most preferably at least 0.9 mm, but not more than 1.5 mm, preferably not more than 1.4 mm, more preferably not more than 1.3 mm, and most preferably not more than 1.2 mm. An intermediate layer thickness lower than the above range will reduce the durability of the ball, whereas a thickness higher than the above range will worsen the feel of the ball.

If the intermediate layer is to be thinly formed as described above, to avoid the risk of defective molding, the intermediate layer-forming composition may first be molded to a thickness of 1.0 mm or more with an injection molding machine and areas of excess thickness subsequently ground down to give an intermediate layer of the desired thickness.

The intermediate layer is formed so as to be harder than the envelope layer and the subsequently described cover. The material of which the intermediate layer is made has a Shore D hardness of at least 55, preferably at least 56, more preferably at least 57, and most preferably at least 58, but not more than 75, preferably not more than 70, more preferably not more than 67, and most preferably not more than 65. If the intermediate layer material is too soft, the spin rate will increase, lowering the flight performance of the ball. On the other hand, if the material is too hard, the feel of the ball on impact will worsen.

Forming the intermediate layer so as to be thicker than the envelope layer and the subsequently described cover—that is, forming the intermediate layer so that it is the thickest among the intermediate layer, envelope layer and cover, is advantageous for achieving good durability.

If necessary, an adhesive may be used at the interface between the intermediate layer and the cover layer to provide the ball with a better durability to impact. Any suitable adhesive may be selected for this purpose, insofar as the objects of the invention are attainable. Preferred examples of such adhesives include chlorinated polyolefin adhesives (e.g., RB182 Primer, made by Nippon Bee Chemical Co., Ltd.), urethane resin adhesives (e.g., Resamine D6208, made by Dainichi Seika Colour & Chemicals Mfg. Co., Ltd.), epoxy resin adhesives, vinyl resin adhesives, and rubber adhesives. The thickness of the adhesive layer is not subject to any particular limitation, although a thickness of 0.1 to 30 μm is preferred. It is also acceptable to use the adhesive on only part of the intermediate layer surface.

The use of such an adhesive can be omitted by the suitable addition to the intermediate layer of a compound having at least two reactive functional groups and a molecular weight of not more than 20,000. Examples of such compounds having at least two reactive functional groups that may be used include monomers, oligomers and macromonomers which have a total of at least two, and preferably at least three, reactive functional groups of one or more type on each molecule and have a molecular weight of not more than 20,000, and preferably not more than 5,000. The number of reactive functional groups, while not subject to any particular upper limit, is generally five or less, and especially four or less.

"Monomer" is used here in the usual sense of a compound employed as a basic building block in polymer product which is obtained from monomers commonly employed in polymer synthesis and which contains generally at least two monomer units and has a molecular weight of up to several thousand. "Macromonomer" refers to a material which is an oligomer having polymerizable functional groups at the ends and which is employed in the synthesis of graft polymers by copolymerization with various types of functional comonomers. Macromonomers typically have a molecular weight of from several thousand to several tens of thousand. They are generally used as intermediates in the synthesis of plastics and elastomers, and as starting materials for the production of graft polymers. Notable use is being made recently of oligomers and macromonomers having various functions.

The reactive functional groups are not subject to any particular limitation, provided they are capable of improving adhesion between the components of the golf ball. Preferred examples of reactive functional groups include hydroxyl groups, carbonyl groups, carboxyl groups and amino groups. In the case of a blend with an ionomer resin, hydroxyl groups are especially preferred because they have little effect on the melt flow rate.

Illustrative, non-limiting, examples of suitable monomers include 1,3-butanediol, 1,6-hexanediol and trimethylolpropane. Illustrative, non-limiting examples of suitable oligomers and macromonomers include polyethylene glycol, polyhydroxypolyolefin oligomers, modified low-molecular-weight polyethylene, modified low-molecular-weight polypropylene, modified low-molecular-weight polystyrene, modified liquid polybutadiene and modified liquid rubber. Polyhydroxypolyolefin oligomers and trimethylolpropane are especially preferred. These may be used singly or as combinations of two or more types thereof, as desired.

The above monomer, oligomer or macromonomer may be a commercially available product, such as trimethylolpropane produced by Mitsubishi Gas Chemical Co., Ltd. or the polyhydroxypolyolefin oligomers which have 150 to 200 backbone carbons and also hydroxyl end groups and are produced under the trade name Polytail H by Mitsubishi Chemical Corporation.

Next, the cover is described. The cover can be produced from a known cover material and in each case may be composed primarily of, for example, a thermoelastic or thermoset polyurethane elastomer, a polyester elastomer, an ionomer resin, an ionomer resin having a relatively high degree of neutralization, a polyolefin elastomer, or a mixture thereof. These can be used singly or as mixtures of two or more thereof. The use of a thermoplastic polyurethane elastomer, an ionomer resin, or an ionomer resin having a relatively high degree of neutralization is especially preferred.

The above-described thermoplastic polyurethane elastomer may be a commercial product. Illustrative examples include those made with an aliphatic or aromatic diisocyanate, such as Pandex T7298, Pandex T7295, Pandex T7890, Pandex TR3080, Pandex T8290, Pandex T8295 and Pandex T1188 (all manufactured by DIC Bayer Polymer, Ltd.). Illustrative examples of commercial ionomer resins include Surlyn 6320, Surlyn 8945, Surlyn 9945 and Surlyn 8120 (E.I. du Pont de Nemours & Co.), and Himilan 1706, Himilan 1605, Himilan 1855, Himilan 1557, Himilan 1601 and Himilan AM7316 (DuPont-Mitsui Polychemicals Co., Ltd.).

Polymers, including thermoplastic elastomers other than the above, may be blended as optional ingredients with the above-described primary component of the cover. Specific examples of polymers that may be used as optional ingredients include polyamide elastomers, styrene block elastomers, hydrogenated polybutadienes and ethylene-vinyl acetate (EVA) copolymers.

The cover thickness is at least 0.6 mm, preferably at least 0.65 mm, more preferably at least 0.7 mm, and most preferably at least 0.75 mm, but not more than 3.0 mm, preferably not more than 2.5 mm, more preferably not more than 2.0 mm, and most preferably not more than 1.6 mm.

The material of which the cover is made has a Shore D hardness of generally at least 30, preferably at least 35, more preferably at least 40, and most preferably at least 45, but generally not more than 60, preferably not more than 58, more preferably not more than 56, and most preferably not more than 54. If the cover material is too soft, the spin rate when the ball is hit with a driver may increase, adversely affecting the flight performance of the ball. Conversely, if the cover material is too hard, the spin rate on an approach shot may decrease, worsening the feel of the ball.

To achieve a good balance between the flight of the ball when hit with a driver and its spin on approach shots, the difference between the hardness of the cover material and the hardness of the intermediate layer, as expressed in Shore D hardness units, while not subject to any particular limitation, is preferably at least 2, more preferably at least 4, and even more preferably at least 6, but preferably not more than 30, more preferably not more than 25, and even more preferably not more than 20.

Moreover, in the practice of the invention, the objects of the invention can be achieved by optimizing the combined thickness of the envelope layer, the intermediate layer and the cover. This combined thickness is at least 1.5 mm, preferably at least 1.8 mm, more preferably at least 2.0 mm, and most preferably at least 2.2 mm, but not more than 3.5 mm, preferably not more than 3.4 mm, more preferably not more than 3.3 mm, and most preferably not more than 3.2 mm.

The cover has a plurality of dimples on the surface thereof. The number of dimples is generally at least 250, preferably at least 270, more preferably at least 290, and even more preferably at least 310, but generally not more than 420, preferably not more than 415, more preferably not more than 410, and even more preferably not more than 405. Within this range, the ball readily incurs lift forces, enabling the distance traveled by the ball, particularly on shots with a driver, to be increased. To better increase the surface coverage ratio of the dimples, it is recommended that the dimples be formed in at least four types of mutually differing diameter and/or depth, preferably at least five types, and more preferably at least 6 types, but generally not more than 20 types, preferably not more than 15 types, and more preferably not more than 12 types. The dimples are preferably formed so as to be circular as viewed from above, and have an average diameter of generally at least 3.7 mm, and preferably at least 3.75 mm, but generally not more than 5.0 mm, preferably not more thane 4.7 mm, more preferably not more than 4.4 mm, and most preferably not more than 4.2 mm. To achieve an appropriate trajectory, it is desirable for the dimples to have an average depth of generally at least 0.125 mm, preferably at least 0.130 mm, more preferably at least 0.133 mm, and most preferably at least 0.135, but generally not more than 0.150 mm, preferably not more than 0.148 mm, more preferably not more than 0.146 mm, and most preferably not more than 0.144 mm. As used herein, "average diameters refers to the mean value for the diameters of all the dimples, and average depth" refers to the mean value for the depths of all the dimples. The diameter of a dimple is measured as the distance across the dimple between positions where the dimple region meets land (non-dimple) regions, that is, between the highest points of the dimple region. The golf ball is usually painted, in which case the dimple diameter refers to the diameter when the surface of the ball has been covered with paint. The depth of a dimple is measured by connecting together the positions where the dimple meets the surrounding land so as to define an imaginary plane, and determining the vertical distance from a center position on the plane to the bottom (deepest position) of the dimple.

If necessary, the surface of the golf ball can be marked, painted and surface treated.

The multi-piece solid golf ball of the invention can be manufactured in accordance with the Rules of Golf for use in competitive play, in which case the ball may be formed to a diameter of not less than 42.67 mm and a weight of not more than 45.93 g. The upper limit for the diameter is generally not more than 44.0 mm, preferably not more than 43.5 mm, and more preferably not more than 43.0 mm. The lower limit for the weight is generally not less than 44.5 g, preferably not less than 45.0 g, more preferably not less than 45.1 g, and even more preferably not less than 45.2 g.

The multi-piece solid golf ball of the invention can be manufactured using an ordinary process such as a known injection molding process. For example, a molded and vulcanized article composed primarily of the base rubber is placed as the solid core within a specific injection-molding mold, following which the envelope layer-forming material and the intermediate layer-forming material are injection-molded in this order to give an intermediate spherical body. The spherical body then is placed within another injection-molding mold, where the cover material is injection molded, thereby giving a multi-piece golf ball. The process for enclosing the intermediate spherical body within the cover, while not subject to any particular limitation, may involve covering the intermediate spherical body with two half-cups that have been molded beforehand as hemispherical shells, then forming under applied heat and pressure.

In the multi-piece solid golf ball of the invention, by optimizing the respective thicknesses and hardnesses of the envelope layer, the intermediate layer and the cover and by selectively combining these various layers of the ball, the rebound is enhanced and the spin rate of the ball on full shots with a driver is reduced, increasing the distance traveled by the ball. In addition, the inventive ball also has a good performance on approach shots, making it highly advantageous compared with prior-art golf balls.

EXAMPLES

The following examples of the invention and comparative examples are provided by way of illustration and not by way of limitation.

Examples 1 to 9, Comparative Examples 1 to 8

In each example, a solid core was manufactured by preparing a core composition having one of formulations No. 1 to 8 shown in Table 1, then molding and vulcanizing the composition under the vulcanization conditions in Table 1. Next, an envelope layer, an intermediate layer and a cover were each injection molded about the core using one of the formulations A to K shown in Table 2, thereby successively forming and enclosing the periphery of the solid core with an envelope layer, an intermediate layer and a cover. In addition, dimples in the number of types indicated in Table 3 were used in combination, giving a multi-piece solid golf ball having 330 to 432 dimples formed on the surface of the cover. With regard to the envelope layer, a 1.1 mm thick laminate was formed using an injection molding machine, following which the envelope layer was ground to the thickness for that particular example, as indicated in Tables 3 and 4.

TABLE 1

| | | | Parts by weight | | | | | | | |
|---|---|---|---|---|---|---|---|---|---|---|
| | | | No. 1 | No. 2 | No. 3 | No. 4 | No. 5 | No. 6 | No. 7 | No. 8 |
| Core formulations | Base rubber | BR01 | | | | 100 | | | | |
| | | BR730 | 95 | 100 | 100 | | 100 | 100 | 100 | 100 |
| | | IR2200 | 5 | | | | | | | |
| | Perhexa C-40 (half-life, 40) | | 3 | 0.3 | 0.3 | 0.6 | 0.3 | 0.3 | | 0.3 |
| | (true amount of addition) | | (1.2) | (0.12) | (0.12) | (0.24) | (0.12) | (0.12) | | (0.12) |
| | Percumyl D (half life, 480) | | | 0.3 | 0.3 | 0.6 | 0.3 | 0.3 | 1 | 0.3 |
| | Sulfur | | 0.1 | | | | | | | |
| | Zinc oxide | | 18.9 | 21.2 | 20.8 | 20.7 | 17.4 | 23.3 | 19.4 | 22 |
| | Antioxidant | | | 0.1 | 0.1 | 0.1 | 0.1 | 0.1 | 0.1 | 0.1 |
| | Zinc acrylate | | 35 | 26.5 | 28.5 | 28.5 | 35 | 21.5 | 32.5 | 28.5 |
| | Zinc stearate | | 5 | 5 | 5 | 5 | | 5 | 5 | 5 |
| | Zinc salt of pentachlorothiophenol | | 1.5 | 1 | 0.3 | 0.3 | 0 | 1 | 0.3 | 0.3 |
| Vulcanization conditions | Primary vulcanization | Temp. (° C.) | 160 | 160 | 160 | 160 | 160 | 160 | 135 | 160 |
| | | Time (min) | 17 | 17 | 17 | 17 | 17 | 17 | 40 | 17 |
| | Secondary vulcanization | Temp. (° C.) | | | | | | | 170 | |
| | | Time (min) | | | | | | | 5 | |

Trade names for most of the materials appearing in the table are as follows.

Polybutadiene rubber: BR01
Nickel catalyst; cis-1,4 bond content, 96%; 1,2-vinyl bond content, 2.5%; Mooney viscosity, 46; Mw/Mn=4.2; produced by JSR Corporation.

Polybutadiene rubber: BR730
Neodymium catalyst; cis-1,4 bond content, 96%; 1,2-vinyl bond content, 1.3%; Mooney viscosity, 55; Mw/Mn=3; produced by JSR Corporation.

Polyisoprene rubber: IR2200
cis-1,4 bond content, 98%; Mooney viscosity, 82; produced by JSR Corporation.

Perhexa C-40: 40% Dilution in 1,1-bis(t-butylperoxy)cyclohexane; produced by NOF Corporation.

Percumil D: Dicumyl peroxide, produced by NOF Corporation.

Sulfur: Sulfur Z, a powdered sulfur produced by Tsurumi Chemical Industry Co., Ltd.
Zinc oxide: Produced by Sakai Chemical Industry Co., Ltd.
Antioxidant: 2,2'-Methylenebis(4-methyl-6-t-butylphenol), produced as Nocrac NS-6 by Ouchi Shinko Chemical Industry Co.
Zinc acrylate: Produced by Nihon Jyoryu Kogyo Co., Ltd.
Zinc stearate: Produced by NOF Corporation
Dicumyl peroxide: Percumyl D produced by NOF Corporation

TABLE 2

| | Formulation (pbw) | | | | | | | | | | |
|---|---|---|---|---|---|---|---|---|---|---|---|
| | A | B | C | D | E | F | G | H | I | J | K |
| Himilan 1605 | | 65 | | 68.75 | 100 | | | | | | |
| Himilan 1555 | 35 | | | | | | 35 | | | | |
| Himilan 1557 | 35 | | | | | | 35 | | | | |
| Surlyn 7930 | | | | | | 100 | | | | | |
| Hytrel 4001 | | | 100 | | | | | | | | |
| Primalloy N2800 | 25 | | | | | | 25 | | | | |
| Dynaron 6100P | | 35 | | 31.25 | | | | | | | |
| Dynaron 4630 | 5 | | | | | | 5 | | | | |
| Pandex T8260 | | | | | | | | | | 50 | 100 |
| Pandex T8295 | | | | | | | | 75 | 50 | 50 | |
| Pandex T8290 | | | | | | | | 25 | 50 | | |
| Behenic acid | | 18 | | 18 | | | | | | | |
| Calcium hydroxide | | 2.3 | | 2.3 | | | | | | | |
| Trimethylolpropane | | | | | 0.8 | 0.8 | 0.8 | | | | |
| Polytail H | | | | 2 | | | | | | | |
| Titanium dioxide | | | | | | | | 4 | 4 | 4 | 4 |
| Barium sulfate | 20 | 20 | | | | | | | | | |
| Magnesium stearate | 1 | 1 | | | | | | | | | |
| Polyethylene wax | | | | | | | | 1.5 | 1.5 | 1.5 | 1.5 |
| Crossnate EM30 | | | | | | | | 15 | 15 | 15 | 15 |

Trade names for most of the materials appearing in the table are as follows.
Himilan: Ionomer resins produced by DuPont-Mitsui Polychemicals Co., Ltd.
Surlyn: An ionomer resin produced by E.I. du Pont de Nemours & Co.
Hytrel: A polyester elastomer produced by DuPont-Toray Co., Ltd.
Primalloy: A polyester elastomer produced by Mitsubishi Chemical Corporation
Dynaron: A hydrogenated butadiene-styrene block copolymer produced by JSR Corporation.
Pandex: Thermoplastic polyurethane elastomers produced by Dainippon Ink & Chemicals, Inc.
Polytail H: A low-molecular-weight polyolefin-type polyol produced by Mitsubishi Chemical Corporation
Crossnate EM30: An isocyanate compound master batch which is produced by Dainichi Seika Colour & Chemicals Mfg. Co., Ltd and contains 30% of 4,4'-diphenylmethane diisocyanate.

The golf balls obtained in above Examples 1 to 9 and Comparative Examples 1 to 9 were each evaluated for ball hardness, ball properties, flight performance, spin rate on approach shots, and feel. The results are shown in Tables 3 and 4. All measurements were carried out in a 23° C. environment.

Core Surface Hardness and Center Hardness

Both hardnesses were measured as Shore D hardnesses (using a type D durometer according to ASTM-2240).

The surface hardness was the average of the values measured at two randomly selected points on the core surface.

The center hardness was the average of the values obtained by cutting the core in half and measuring the hardness at the center of the cut faces on the two resulting hemispheres.

Hardness of Envelope Laver Material

The resin material used to make the envelope layer was formed into a sheet, and measurement was carried out using a type D durometer in accordance with ASTM-2240.

Hardness of Intermediate LaVer Material

Measured by the same method as above.

Hardness of Cover Material

Measured by the same method as above.

Ball Hardness

The deflection (mm) of the resulting ball when subjected to a load of 100 kg (980 N) was measured.

Rebound

The initial velocity was measured using an initial velocity instrument of the same type as that used by the official regulating body—the United States Golf Association (USGA).

Distance

The total distance traveled by the ball when hit at a head speed (HS) of 52 m/s with a driver (Tour Stage X-DRIVE TYPE 300 PROSPEC, made by Bridgestone Sports Co., Ltd.; loft angle, 8°) mounted on a swing robot (Miyamae Co., Ltd.) was measured. The spin rate and initial velocity were values measured from high-speed camera images of the ball taken immediately after impact.

Spin Rate on Approach Shots

The spin rate of a ball hit at a head speed of 20 m/s with a sand wedge (abbreviated below as "SW"; Tour Stage X-wedge, made by Bridgestone Sports Co., Ltd.; loft angle, 58°) was measured. The spin rate was measured by the same method as that used above when measuring distance.

Feel

The feel of each ball when teed up and hit with a driver and when hit with a putter was evaluated by ten amateur golfers, and was rated as indicated below based on the number of golfers who responded that the ball had a "soft" feel. An X-DRIVE TYPE 300 PROSPEC having a loft angle of 10° was used as the driver, and a Tour Stage ViQ Model-III was used as the putter. Both clubs are made by Bridgestone Sports Co., Ltd.

Poor: 1 to 3 golfers who rated the ball as "soft."
Ordinary: 4 to 6 golfers who rated the ball as "soft."
Good: 7 to 10 golfers who rated the ball as "soft."

TABLE 3

| | | Example | | | | | | | | |
|---|---|---|---|---|---|---|---|---|---|---|
| | | 1 | 2 | 3 | 4 | 5 | 6 | 7 | 8 | 9 |
| Core | Type | No. 1 | No. 2 | No. 3 | No. 3 | No. 3 | No. 3 | No. 2 | No. 3 | No. 4 |
| | Diameter (mm) | 36.4 | 36.4 | 36.4 | 36.4 | 36.4 | 36.4 | 36.4 | 37.9 | 36.4 |
| | Center hardness (Shore D) | 37 | 31 | 36 | 36 | 36 | 36 | 31 | 36 | 36 |
| | Surface hardness (Shore D) | 60 | 45 | 50 | 50 | 50 | 50 | 45 | 50 | 50 |
| | Surface – center hardness difference (Shore D) | 23 | 14 | 14 | 14 | 14 | 14 | 14 | 14 | 14 |
| Envelope layer | Type | A | A | A | A | B | A | B | A | A |
| | Hardness of material (Shore D) | 52 | 52 | 52 | 52 | 58 | 52 | 58 | 52 | 52 |
| | Thickness (mm) | 0.9 | 0.9 | 0.9 | 0.9 | 0.9 | 0.9 | 0.9 | 0.6 | 0.9 |
| Intermediate layer | Type | D | D | D | D | E | D | F | D | D |
| | Hardness of material (Shore D) | 58 | 58 | 58 | 58 | 63 | 58 | 65 | 58 | 58 |
| | Thickness (mm) | 1.2 | 1.2 | 1.2 | 1.2 | 1.2 | 1.2 | 1.2 | 1.0 | 1.2 |
| Cover | Type | H | H | H | I | I | J | I | I | I |
| | Hardness of material (Shore D) | 50 | 50 | 50 | 47 | 47 | 55 | 47 | 47 | 47 |
| | Diameter (mm) | 42.7 | 42.7 | 42.7 | 42.7 | 42.7 | 42.7 | 42.7 | 42.7 | 42.7 |
| | Weight (g) | 45.4 | 45.4 | 45.4 | 45.4 | 45.4 | 45.4 | 45.4 | 45.6 | 45.4 |
| | Thickness (mm) | 1.0 | 1.0 | 1.0 | 1.0 | 1.0 | 1.0 | 1.0 | 0.8 | 1.0 |
| Combined cover thickness (mm) | | 3.1 | 3.1 | 3.1 | 3.1 | 3.1 | 3.1 | 3.1 | 2.4 | 3.1 |
| Dimples | Number of dimples | 330 | 330 | 408 | 408 | 330 | 330 | 408 | 330 | 330 |
| | Average dimple diameter (mm) | 4.198 | 4.198 | 3.792 | 3.792 | 4.198 | 4.198 | 3.792 | 4.198 | 4.198 |
| | Average dimple depth (mm) | 0.143 | 0.143 | 0.141 | 0.141 | 0.143 | 0.143 | 0.141 | 0.143 | 0.143 |
| | Number of dimple types | 10 | 10 | 6 | 6 | 10 | 10 | 6 | 10 | 10 |
| Hardness (mm) | | 2.1 | 3.0 | 2.4 | 2.4 | 2.2 | 2.3 | 2.1 | 2.6 | 2.4 |
| Rebound (initial velocity at 23° C., m/s) | | 77.4 | 77.3 | 77.4 | 77.4 | 77.6 | 77.4 | 77.6 | 77.6 | 77.0 |
| Distance | Spin rate at HS 52 (rpm) | 2850 | 2740 | 2860 | 2950 | 2810 | 2700 | 2770 | 2880 | 2940 |
| | Total distance (m) | 266.5 | 264.0 | 265.5 | 265.0 | 267.0 | 266.0 | 267.5 | 266.5 | 263.5 |
| Approach shots (spin rate at HS 20, rpm) | | 7040 | 6890 | 7180 | 7270 | 7090 | 7020 | 7050 | 7210 | 7260 |
| Feel | Driver | good | good | good | good | good | good | good | good | good |
| | Putter | good | good | good | good | good | good | good | good | good |

TABLE 4

| | | Comparative Example | | | | | | | | |
|---|---|---|---|---|---|---|---|---|---|---|
| | | 1 | 2 | 3 | 4 | 5 | 6 | 7 | 8 | 9 |
| Core | Type | No. 5 | No. 6 | No. 7 | No. 3 | No. 3 | No. 3 | No. 3 | No. 8 | No. 3 |
| | Diameter (mm) | 36.4 | 36.4 | 36.4 | 35.8 | 35.0 | 36.4 | 36.4 | 36.4 | 36.4 |
| | Center hardness (Shore D) | 46 | 28 | 42 | 36 | 36 | 36 | 36 | 36 | 36 |
| | Surface hardness (Shore D) | 61 | 38 | 45 | 50 | 50 | 50 | 50 | 50 | 50 |
| | Surface – center hardness difference (Shore D) | 15 | 10 | 3 | 14 | 14 | 14 | 14 | 14 | 14 |
| Envelope layer | Type | A | A | A | A | A | C | A | | A |
| | Hardness of material (Shore D) | 52 | 52 | 52 | 52 | 52 | 40 | 52 | | 52 |
| | Thickness (mm) | 0.9 | 0.9 | 0.9 | 1.3 | 1.1 | 0.9 | 0.9 | | 0.9 |
| Intermediate layer | Type | D | D | D | D | D | G | D | D | D |
| | Hardness of material (Shore D) | 58 | 58 | 58 | 58 | 58 | 51 | 58 | 58 | 58 |
| | Thickness (mm) | 1.2 | 1.2 | 1.2 | 1.2 | 1.2 | 1.2 | 1.2 | 1.7 | 1.2 |
| Cover | Type | H | H | H | H | H | H | K | I | H |
| | Hardness of material (Shore D) | 50 | 50 | 50 | 50 | 50 | 50 | 62 | 47 | 50 |

TABLE 4-continued

| | | Comparative Example | | | | | | | | |
|---|---|---|---|---|---|---|---|---|---|---|
| | | 1 | 2 | 3 | 4 | 5 | 6 | 7 | 8 | 9 |
| | Diameter (mm) | 42.7 | 42.7 | 42.7 | 42.7 | 42.7 | 42.7 | 42.7 | 42.7 | 42.7 |
| | Weight (g) | 45.4 | 45.4 | 45.4 | 45.4 | 45.4 | 45.5 | 45.4 | 45.4 | 45.4 |
| | Thickness (mm) | 1.0 | 1.0 | 1.0 | 1.0 | 1.6 | 1.0 | 1.0 | 1.4 | 1.0 |
| Combined cover thickness (mm) | | 3.1 | 3.1 | 3.1 | 3.4 | 3.8 | 3.1 | 3.1 | 3.1 | 3.1 |
| Dimples | Number of dimples | 330 | 330 | 330 | 330 | 330 | 330 | 330 | 330 | 432 |
| | Average dimple diameter (mm) | 4.198 | 4.198 | 4.198 | 4.198 | 4.198 | 4.198 | 4.198 | 4.198 | 3.643 |
| | Average dimple depth (mm) | 0.143 | 0.143 | 0.143 | 0.143 | 0.143 | 0.143 | 0.143 | 0.143 | 0.150 |
| | Number of dimple types | 10 | 10 | 10 | 10 | 10 | 10 | 10 | 10 | 7 |
| Hardness (mm) | | 1.7 | 3.9 | 2.2 | 2.3 | 2.4 | 3.0 | 2.1 | 2.2 | 2.4 |
| Rebound (initial velocity at 23° C., m/s) | | 77.5 | 77.0 | 77.2 | 77.1 | 76.8 | 76.6 | 77.1 | 77.2 | 77.4 |
| Distance | Spin rate at HS 52 (rpm) | 3090 | 2560 | 3010 | 2980 | 3030 | 3210 | 2470 | 3020 | 2860 |
| | Total distance (m) | 263.5 | 261.0 | 262.0 | 262.0 | 261.5 | 260.0 | 264.0 | 262.5 | 262.0 |
| Approach shots (spin rate at HS 20, rpm) | | 7750 | 6160 | 7230 | 7160 | 7150 | 7230 | 4890 | 7280 | 7180 |
| Feel | Driver | poor | good | poor | good | good | good | ordinary | good | good |
| | Putter | poor | good | ordinary | good | good | good | poor | good | good |

The results in Tables 3 and 4 show that, in Comparative Example 1, because the core was formed with a high center hardness, the spin rate on shots with a driver was too high, lowering the distance traveled by the ball and making the feel of the ball on impact hard and unpleasant. In Comparative Example 2, the core was formed with a low surface hardness, as a result of which the ball had a low rebound, shortening the distance and compromising the spin performance on approach shots. In Comparative Example 3, the ball was designed with a small core hardness distribution, as a result of which the spin rate on shots with a driver was too high, lowering the distance traveled and giving the ball a hard and unpleasant feel. In Comparative Example 4, the envelope layer was formed so as to be thick, as a result of which the spin rate increased on shots with a driver and the rebound decreased, shortening the distance traveled by the ball. In Comparative Example 5, the cover was formed so as to be thick, as a result of which the spin rate on shots with a driver increased and the rebound decreased, shortening the distance traveled by the ball. In Comparative Example 6, the envelope layer and intermediate layer were formed so as to be soft, resulting in an excessively high spin rate on shots with a driver, a smaller rebound, and a shortened distance. In Comparative Example 7, the intermediate layer was made soft and the cover was made hard, resulting in a low spin rate on approach shots and a poor feel on shots with a putter. The ball in Comparative Example 8 was a three-piece golf ball without an envelope layer, resulting in an increased spin rate on shots with a driver, a smaller rebound, and a shortened distance. In Comparative Example 9, the dimples on the ball's surface were not optimized, resulting in a shorter distance of travel by the ball.

The invention claimed is:

1. A multi-piece solid golf ball, comprising a solid core, an envelope layer that encloses the solid core, an intermediate layer that encloses the envelope layer, and a cover that encloses the intermediate layer and has a plurality of dimples on a surface thereof, wherein the solid core has a diameter of 36.3 to 41.0 mm, a center hardness expressed as the Shore D hardness of 15 to 45, a surface hardness expressed as the Shore D hardness of 40 to 63, and a hardness difference between the center and surface, expressed in Shore D hardness units, of 10 to 40; the envelope layer is made primarily of a resin, has a thickness of 0.2 to 0.9 mm and the material of which it is made has a Shore D hardness of 45 to 58; the intermediate layer has a thickness of 0.5 to 1.5 mm, the material of which it is made has a Shore D hardness of 55 to 75, and the intermediate layer is formed so as to be harder than the envelope layer and the cover; the cover has a thickness of 0.6 to 1.5 mm and the material of which it is made has a Shore D hardness of 30 to 60; the cover material and the intermediate layer material have a Shore D hardness difference therebetween of 2 to 30; and the combined thickness of the envelope layer, intermediate layer and cover is from 1.5 to 3.5 mm, wherein the material of which the intermediate layer is made includes trimethylolpropane or polyhydroxypolyolefin oligomers.

2. The multi-piece solid golf ball of claim 1, wherein the solid core is composed primarily of a polybutadiene which has a cis-1,4 bond content of at least 60 wt % and is synthesized using a rare-earth catalyst.

3. The multi-piece solid golf ball of claim 1, wherein the envelope layer and intermediate layer are made primarily of a thermoplastic resin selected from among ionomer resins, polyester elastomers, polyamide elastomers, polyurethanes, and mixtures thereof.

4. The multi-piece solid golf ball of claim 1, wherein the cover is made primarily of a thermoplastic or thermoset polyurethane.

5. The multi-piece solid golf ball of claim 1, wherein the thickness of the intermediate layer is greater than the thickness of each of the envelope layer and the cover.

6. The multi-piece solid golf ball of claim 1, wherein the number of dimples is from 250 to 420 and the dimples overall have an average depth of 0.125 to 0.150 mm, an average diameter of 3.7 to 5.0 mm and are composed of a combination of four or more dimple types.

7. The multi-piece solid golf ball of claim 1, wherein the core includes an organosulfur compound selected from the group consisting of thiophenols, thionaphthols, halogenated thiophenols, and metal salts thereof, and polysulfides having 2 to 4 sulfurs.

8. The multi-piece solid golf ball of claim 7, wherein the organosulfur compound is selected from the group consisting of pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs.

9. The multi-piece solid golf ball of claim 7, wherein the amount of the organosulfur compound included per 100 parts by weight of the base rubber is at least 0.1 part by weight but not more than 4 parts by weight.

10. The multi-piece solid golf ball of claim 1, wherein the material of the envelope layer has a Shore D hardness of at least 47 but not more than 58.

11. The multi-piece solid golf ball of claim 1, wherein the difference between the hardness of the cover material, and the hardness of the intermediate layer is at least 2 but not more than 20, as expressed in Shore D hardness units.

12. The multi-piece solid golf ball of claim 1, wherein the diameter of the solid core is from 37.9 to 39.0 mm.

13. A multi-piece solid golf ball, comprising a solid core, an envelope layer that encloses the solid core, an intermediate layer that encloses the envelope layer, and a cover that encloses the intermediate layer and has a plurality of dimples on a surface thereof, wherein the solid core has a diameter of 36.3 to 41.0 mm, a center hardness expressed as the Shore D hardness of 15 to 45, a surface hardness expressed as the Shore D hardness of 40 to 63, and a hardness difference between the center and surface, expressed in Shore D hardness units, of 10 to 40; the envelope layer has a thickness of 0.2 to 0.9 mm and the material of which it is made has a Shore D hardness of 45 to 65; the intermediate layer has a thickness of 0.5 to 1.5 mm, the material of which it is made has a Shore D hardness of 55 to 75, and the intermediate layer is formed so as to be harder than the envelope layer and the cover; the cover has a thickness of 0.6 to 1.5 mm and the material of which it is made has a Shore D hardness of 30 to 60; the cover material and the intermediate layer material have a Shore D hardness difference therebetween of 2 to 30; and the combined thickness of the envelope layer, intermediate layer and cover is from 1.5 to 3.5 mm, wherein the material of which the intermediate layer is made includes trimethylolpropane or polyhydroxypolyolefin oligomers.

* * * * *